US007726057B2

(12) United States Patent
Brinkman et al.

(10) Patent No.: US 7,726,057 B2
(45) Date of Patent: Jun. 1, 2010

(54) ROLL FORMED CHANNEL FOR ELECTRONIC PRICE LABEL UNITS

(75) Inventors: Michael Brinkman, Belvidere, IL (US); Mary Kirby, Beloit, WI (US); Thomas E. Valiulis, Rockford, IL (US); Patrick J. Barkdoll, Pecatonica, IL (US); Stanley C. Valiulis, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 166 days.

(21) Appl. No.: 11/748,830

(22) Filed: May 15, 2007

(65) Prior Publication Data

US 2008/0282592 A1 Nov. 20, 2008

(51) Int. Cl.
*G09F 3/18* (2006.01)

(52) U.S. Cl. ..... 40/661.03; 248/220.21

(58) Field of Classification Search ..... 40/661.03, 40/661.11, 663, 665; 248/616
See application file for complete search history.

(56) References Cited

U.S. PATENT DOCUMENTS 2,794,279 A * 6/1957 Slavsky et al. ..... 40/650
2,950,554 A * 8/1960 Foster ..... 40/650
4,606,280 A * 8/1986 Poulton et al. ..... 108/97
6,341,755 B1 * 1/2002 Kump ..... 248/220.41
6,553,702 B1 * 4/2003 Bacnik ..... 40/661.03
6,622,410 B2 * 9/2003 Wilkes et al. ..... 40/654
6,935,062 B2 * 8/2005 Lowry et al. ..... 40/661.03
7,287,350 B2 * 10/2007 Fast et al. ..... 40/642.02
7,299,579 B2 * 11/2007 Lowry ..... 40/661.03
2004/0237369 A1 * 12/2004 Andersson ..... 40/661.03

OTHER PUBLICATIONS

Fast Industries Brochure; Electronic Shelf Labels; ESL Placement System; 36 pages.

* cited by examiner

*Primary Examiner*—Lesley Morris
*Assistant Examiner*—Kristina Staley
(74) *Attorney, Agent, or Firm*—Reinhart Boerner Van Deuren P.C.

(57) ABSTRACT

A label holder for attachment to, or integrated into, a retail shelf is provided. The label holder includes a deck and an electronic price label holder. The deck has a front deck portion and a back deck portion. The electronic price label holder is supported by the front deck portion. The label holder also has a back wall extending between a top wall and a bottom wall to form a retention channel. The back wall includes a hinge structure such that an entrance opening in the retention channel is expandable and retractable for receipt of electronic price labels.

26 Claims, 12 Drawing Sheets

ROLL FORMED CHANNEL FOR ELECTRONIC PRICE LABEL UNITS

FIELD OF THE INVENTION

This invention generally relates to attachments for shelves and, in particular, to attachments for holding price labels.

BACKGROUND OF THE INVENTION

In the retail industry, the use of electronic price labels to price label a shelf is growing. Much like traditional paper or plastic labels, the electronic price labels convey a variety of information about the products on the shelf to a consumer. Such information includes, for example, the cost of the products, the unit size of the products, and the like.

The electronic price labels incorporate varying degrees of technology and, therefore, have varying degrees of sophistication. Indeed, some electronic price labels need to be programmed individually at the location of the unit. On the other hand, more advanced electronic price labels having wireless communication capabilities may be programmed from a distant or remote location. For example, a corporate office may update the information displayed on the electronic price labels even though the corporate office is miles and miles away from the location where these advanced electronic prices labels are used.

As number of electronic price labels increases, the need for holders or attachments capable of supporting these electronic price labels on or in front of a retail shelf will correspondingly increase. Unfortunately, there is presently a lack of suitable holders for this purpose. This is the result of several factors. For one, there is no industry standard or common size for the electronic price labels. As a result, the holders for the electronic price labels must be custom built. This is costly for retailers.

In addition, because the electronic devices contain sensitive and fragile electronic equipment, the holders designed to support these devices must be able to protect the electronic price labels from the harsh conditions of the retail environment. For example, the holder must be able to protect the electronic price labels from collisions with shopping carts, product spills and other contaminants, and the like. However, currently available holders for electronic shelf labels, such as those commercially available from Fast Industries, are not sufficient in this regard. If the holders cannot adequately protect the electronic price labels, the labels will likely prematurely fail and have to be replaced. Again, this is costly for retailers.

Also, the holders for electronic price labels are too often subject to intentional removal by parties not associated with the retailer. The presently available holders do not adequately discourage unscrupulous individuals from vandalizing or stealing the electronic price labels. As noted above, the need to replace the electronic price labels is costly.

There exists, therefore, a need in the art for a roll formed channel configured to be supported by a retail shelf and capable of holding an electronic price label that overcomes one or more of the above-noted problems. The invention provides such an electronic price label holder. These and other advantages of the invention, as well as additional inventive features, will be apparent from the description of the invention provided herein.

BRIEF SUMMARY OF THE INVENTION

A label holder is provided. In an exemplary embodiment, the label holder is roll formed from metal and includes a retention channel configured to support an electronic price label holder. The label holder includes a hinge to permit the retention channel to transition between expanded and relaxed states.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
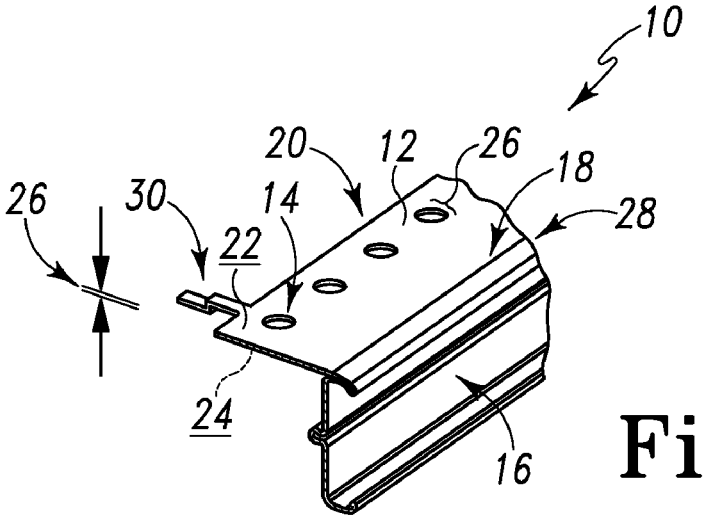
FIG. 1 is a top and front view of an exemplary embodiment of a rolled formed channel in accordance with the teachings of the present invention.

Referring now to FIG. 1, one embodiment of a channel 10 (a.k.a., label holder) is illustrated. In the illustrated embodiment, the channel 10 is generally roll formed. However, stamping or other known metal working methods or techniques may also be employed to form tabs, apertures, or other features. In FIG. 1, the rolled formed channel 10 is fashioned from a metal suitable for use in the roll forming process such as, for example, steel and aluminum. As those skilled in the art know, roll forming is a process that takes metal sheet, usually in coils, and passes it through a series of roller dies that progressively form the metal into the required profile or shape. The roll forming process can save money since some operations, typically considered as secondary, can be combined in the roll forming operation. As shown, the rolled form channel 10 comprises a deck 12, a plurality of deck apertures 14, and an electronic price label holder 16.

The deck 12 generally includes a front deck portion 18 and a rear deck portion 20. Except for part of the front deck portion 18, the deck 12 is generally planar. The deck 12 defines a top surface 22 and a bottom surface 24 on opposing sides of the deck. The deck 12 may have any suitable thickness 26 between the top and bottom surfaces 22, 24 to provide the channel 16 with sufficient strength to support the electronic price label holder 16 and the electronic price labels disposed therein. Because the deck 12 is formed from metal, the deck is generally fairly rigid. However, the deck 12 will flex upon the application of sufficient force as will be discussed more fully below.

Passing through the deck 12 from the top surface 22 to the bottom surface 24 are the deck apertures 14. The deck apertures 14 are generally disposed between the front deck portion 18 and the rear deck portion 20. The deck apertures 14 are spaced apart from each other and, as shown in FIG. 1, arranged in a row 26. The row 26 of deck apertures 14 is generally parallel with a top folded rim 28 of the channel 10.

Although not shown in FIG. 1, the deck apertures 14 may also form several rows instead of a single row 26. In such cases, each of the additional rows (not shown) is generally parallel with the top folded rim 28 of the channel 10 and the row 26 depicted in FIG. 1. Each of these additional rows is progressively further spaced away from the top folded rim 28. The spacing between adjacent rows of deck apertures 14 need not be the same.

The rear deck portion 20 supports a plurality of tabs 30. As shown, the tabs 30 extend horizontally away from the rear deck portion 20. The portion of the tabs 30 furthest away from the rear deck portion 20 is offset below, but generally parallel with, the top surface 22 of the deck 12. The tabs 30 are also spaced apart from each other along a length of the rear deck portion 20. In the illustrated embodiment, the tabs 30 are unitarily formed with the deck 12.

Figure 2:
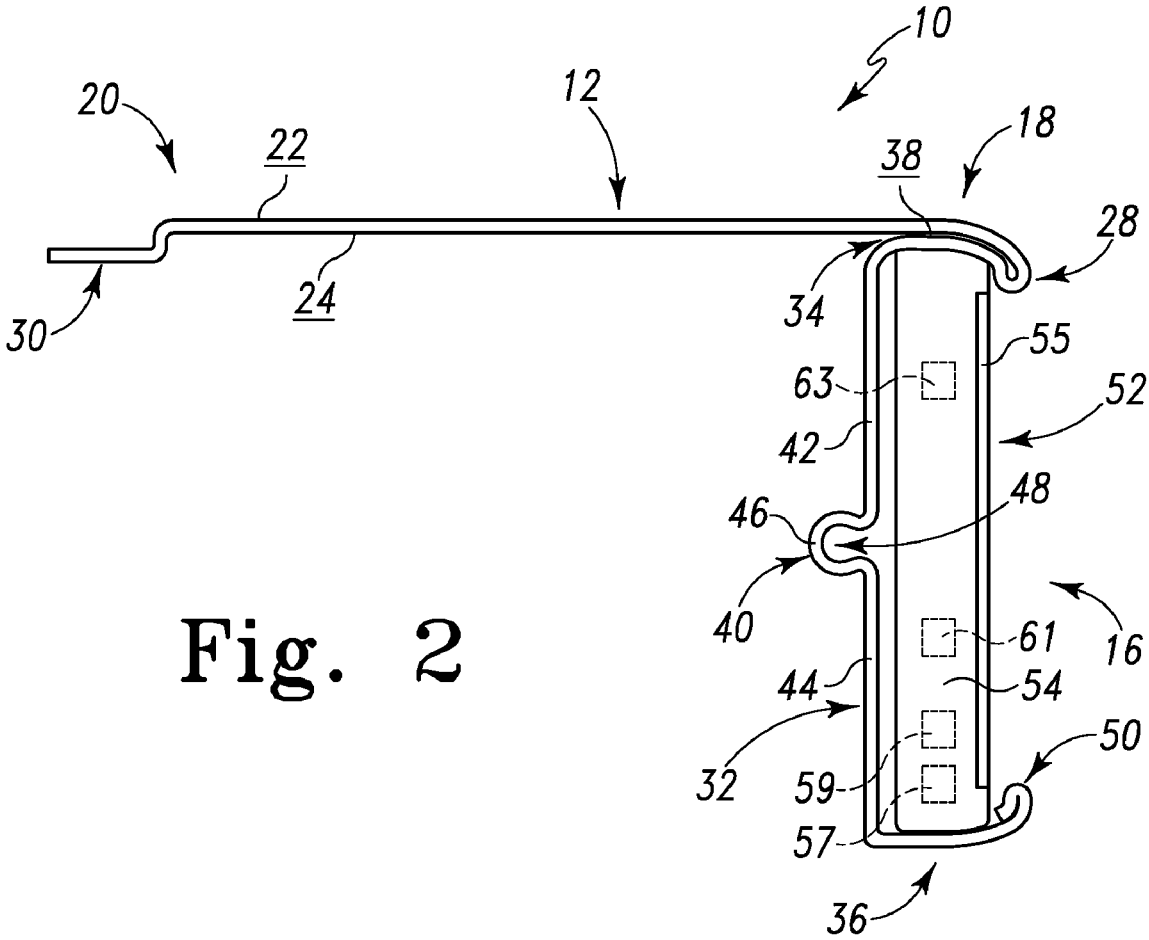
FIG. 2 is a side elevation view of the roll formed channel of FIG. 1.

The electronic price label holder 16 is generally supported by the front deck portion 18 of the channel 10. As shown in FIG. 2, the label holder 16 includes a back wall 32 interposed between a top wall 34 and a bottom wall 36. In the embodiment illustrated of FIG. 2, the top wall 34 generally follows the contour of the bottom surface 24 of the deck 12 within the front deck portion 18. In fact, a top surface 38 of the top wall 34 engages the bottom surface 24 of the deck 12. The top wall 34 is unitarily formed with the front deck portion 18 to form the top folded rim 28. The top folded rim 28 curls generally downwardly toward the bottom wall 36.

The back wall 32 is unitarily formed with and generally transverse to the top wall 34. The back wall 32 includes a pivoting structure 40 (a.k.a., a hinge structure) for flexing the label holder 16. The pivoting structure 40 divides the back wall 32 into an upper wall portion 42 and a lower wall portion 44. In the illustrated embodiment of FIG. 2, the pivoting structure 40 is located about an equal distance from each of the top and bottom walls 34, 36. However, the pivoting structure 40 may be moved either up or down within the back wall 32. As depicted in FIG. 2, the pivoting structure 40 is a rearwardly-facing or extending rounded projection 46 forming an elongated, forwardly-facing trough 48 in the back wall 32. The trough 48 generally extends the entire length of the channel 10 due to the roll forming process of manufacture.

The bottom wall 36 is unitarily formed with the back wall 32 and is, when the pivoting structure 40 is excluded from consideration, generally transverse to the back wall. The bottom wall 36 extends forwardly away from the back wall 32 about the same distance as the top wall 34 extends from the top folded rim 28 back toward the tabs 30. In other words, the top and bottom walls 32, 34 have about the same length. In the illustrated embodiment of FIG. 2, a portion of the bottom wall 36 is folded upwardly and back toward the back wall 32. This portion of the bottom wall 36 folded over upon itself forms a bottom folded rim 50. The bottom folded rim 50 is generally curled upwardly toward the top wall 34 and, in particular, toward the top folded rim 28.

Between the top folded rim 28, the bottom folded rim 50, and the back wall 32, an interior area 52 of the label holder 16 is defined. The interior area 52 is sized and dimensioned to receive an electronic price label (E.P.L.) 54. As shown, the electronic price label 54 is situated within the interior area 52. The electronic price label 54 may engage or be spaced apart from the top wall 34, the bottom wall 36, and the back wall 32. Because the top folded rim 28 and the bottom folded rim 50 extend toward each other, the electronic price label 54 is securely, yet releasably, held within the interior area 52 of the electronic price label holder 16.

The electronic price label 54 depicted in FIG. 2 may suitably include a variety of electronic components such as, for example, a display device 55, a battery 57, a processor 59, a transmitter and/or receiver 61, and an input and/or output 63. Other electronic parts and accessories may also be included to provide the electronic price label 54 with enhanced functionality or features. The display device 55 may be a light-emitting diode (LED) display or a liquid crystal display (LCD). The electronic price label 54 may be any type of electronic label used to convey product information to a consumer, which includes all electronic digital displays and self-illuminating price units that can be altered without having to replace paper or hardware components. In that regard, the electronic price label 54 may be formed from electronic paper, examples of which are described in the following paragraphs.

Electronic paper, also sometimes called "e-paper" or "electronic ink," is a display technology designed to mimic the appearance of regular ink on paper. Unlike a conventional flat panel display, which uses a backlight to illuminate its pixels, electronic paper reflects light like ordinary paper and is capable of holding text and images indefinitely without drawing electricity or using processor power, while allowing the paper to be changed. The pixels in electronic paper should be image stable so that the state of each pixel can be maintained without a constant supply of power.

Electronic paper was first developed in the 1970's by an inventor associated with the Xerox Corporation, which is presently headquartered in Stamford, Conn. The first electronic paper, called Gyricon, consisted of polyethylene spheres between 20 and 100 micrometers across. Each sphere was composed of negatively charged black plastic on one side and positively charged white plastic on the other (each bead was thus a dipole). The spheres were embedded in a transparent silicone sheet, with each sphere suspended in a bubble of oil so that they can rotate freely. The polarity of the voltage applied to each pair of electrodes then determines whether the white or black side is face-up, thus giving the pixel a white or black appearance.

In the 1990's another type of electronic paper was invented. This type of electronic paper used tiny microcapsules filled with electrically charged white particles suspended in a colored oil. In early versions, the underlying circuitry controlled whether the white particles were at the top of the capsule (so it looked white to the viewer) or at the bottom of the capsule (so the viewer saw the color of the oil). This was generally a reintroduction of the well-known electrophoretic display technology, but the use of microcapsules allowed the display to be used on flexible plastic sheets instead of glass.

One early version of electronic paper consisted of a sheet of very small transparent capsules, each about 40 micrometers across. Each capsule contained an oily solution containing black dye (the electronic ink), with numerous white titanium dioxide particles suspended within. The particles were slightly negatively charged, and each one was naturally white.

The microcapsules were held in a layer of liquid polymer, sandwiched between two arrays of electrodes, the upper of which is made from indium tin oxide, a transparent conducting material. The two arrays were aligned so that the sheet was divided into pixels, with each pixel corresponding to a pair of electrodes situated on either side of the sheet. The sheet was laminated with transparent plastic for protection, resulting in an overall thickness of 80 micrometers, or twice that of ordinary paper.

The network of electrodes was connected to display circuitry, which turns the electronic ink "on" and "off" at specific pixels by applying a voltage to specific pairs of electrodes. Applying a negative charge to the surface electrode repels the particles to the bottom of local capsules, forcing the black dye to the surface and giving the pixel a black appearance. Reversing the voltage has the opposite effect—the particles are forced from the surface, giving the pixel a white appearance. A more recent incarnation of this concept requires only one layer of electrodes beneath the microcapsules. Other research efforts into e-paper have involved using organic transistors embedded into flexible substrates, including attempts to build them into conventional paper.

Simple color e-paper usually includes a thin colored optical filter added to the monochrome technology described above. The array of pixels is divided into triads, typically comprising the standard red, green and blue, in the same way as in cathode ray tube (CRT) monitors. The display is then controlled like any other electronic color display. In addition to those types of electronic paper noted above, it is contemplated that other types of electronic paper may be received and held by embodiments of the channel 10 disclosed herein.

Figure 3:
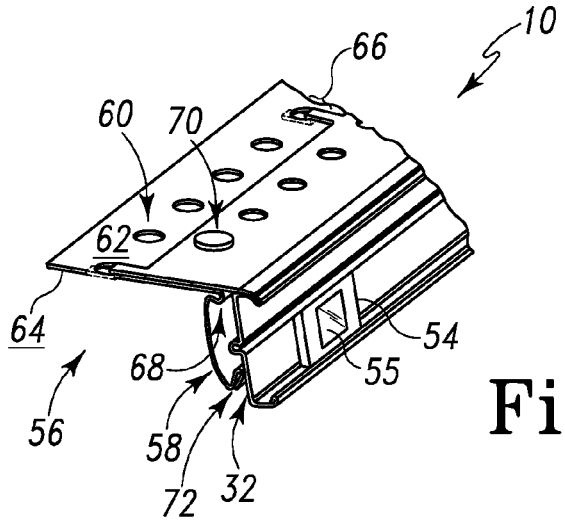
FIG. 3 is a top and front perspective view of the roll formed channel of FIG. 1 engaged with a retail shelf.
Figure 4:
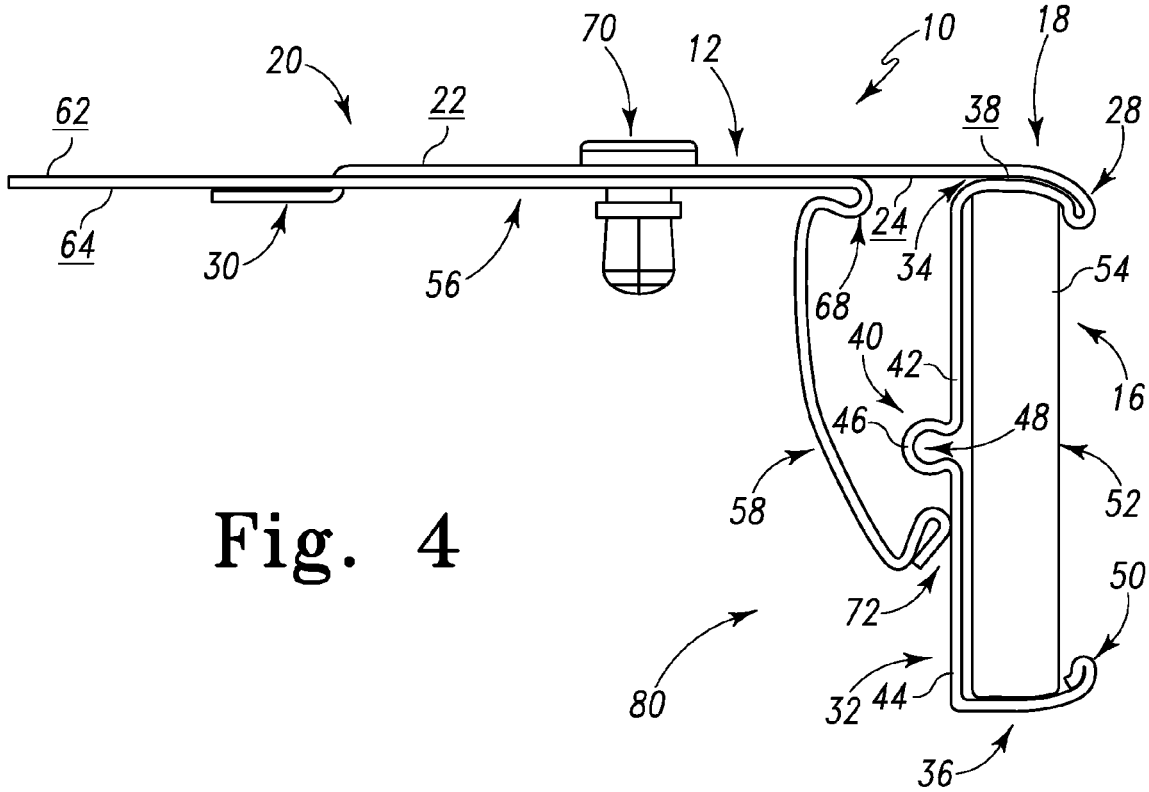
FIG. 4 is a side elevation view of the roll formed channel of FIG. 1 engaged with the retail shelf, the roll formed channel in a relaxed state.

In FIGS. 3-4, the channel 10 of FIG. 1 is shown mounted to a retail shelf 56 with one of the electronic price labels 54 disposed in the interior area 52 of the channel. The retail shelf 56 includes a forward-facing C-channel 58 and a plurality of shelf apertures 60 extending from a top surface 62 of the shelf 56 to a bottom surface 64. Like the deck apertures 14, the shelf apertures are generally organized in spaced-apart rows 66 that run parallel to a front rim 68 of the retail shelf 56.

As shown in FIGS. 3 and 4, the vertical height of the label holder 16 portion of the channel 10, when generally measured from the front deck portion 18 to the bottom wall 36, is greater than the vertical height of the forward-facing C-channel 58, which is an existing C-channel of standard size. Even so, as technology advances, if the electronic price label 54 decreases in size, the vertical height of the label holder 16 may be smaller than the vertical height of the forward-facing C-channel. In the illustrated embodiment, the vertical height of the label holder 16 is between about one half of an inch to about four inches.

To ensure that the retail shelf 56 adequately supports the channel 10, the channel is laid over the retail shelf until one row 26 of the deck apertures 14 is aligned with one row 66 of the shelf apertures 60. Thereafter, the lower portion of a securement device 70 such as, for example, a rivet or a push pin is placed in the apertures 14, 60 to secure the channel 10 to the retail shelf 56. The securement device 70 generally keeps the bottom surface 24 of the deck 12 engaged with the top surface 62 of the retail shelf 62. In the embodiment illustrated in FIGS. 3-4, a bottom lip 72 of the C-channel 58 from the retail shelf 56 engages the back wall 32 of the label holder 16. However, in other embodiments the bottom lip 72 of the C-channel 58 is spaced apart from the back wall 32 of the label holder 16.

Figure 5:
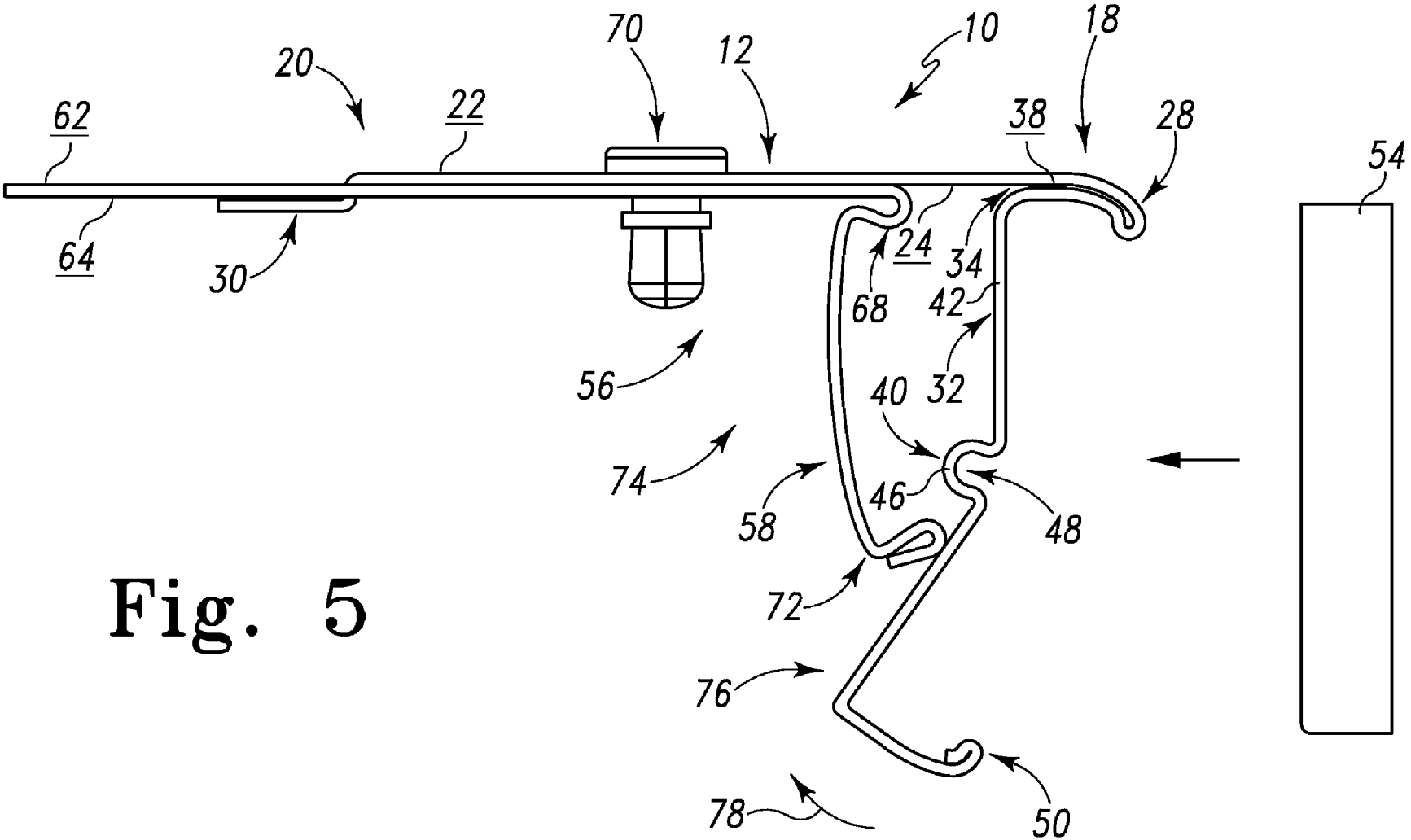
FIG. 5 is a side elevation view of the roll formed channel of FIG. 1 engaged with the retail shelf, the roll formed channel in a flexed state.

In order to insert the electronic price label 54 into, or remove the electronic price label from, the interior area 52 of the label holder 16, the label holder is transitioned into a flexed state 74 as shown in FIG. 5. To place the label holder 16 the flexed state 74, a bottom portion 76 of the label holder 16 is rotated about the pivoting structure 40 due to an application of a force 78. When the force 78 is sufficient, the bottom portion 76 of the label holder 16 pivots rearwardly (toward the tabs 30). In this position, the upper wall portion 42 of the back wall 32 is no longer planar with the lower wall portion 44, the trough 48 is expanded, and the bottom folded rim 50 is pulled further away from the top folded rim 28. With the bottom and top folded rims 28, 50 further distanced from each other, the electronic label 54 may be inserted into the interior area 16.

To secure the electronic price label 54 within the interior area 52 of the label holder 16, the label holder is transitioned into a relaxed state 80 as shown in FIG. 4. To do so, the application of force noted above is slowly released. As this occurs, the bottom portion 76 of the back wall 32 pivots about the pivoting structure 40 in a manner opposite that described above. Therefore, the top folded rim 28 and the bottom folded rim 50 are drawn closer to each other and the trough 48 is generally allowed to resiliently return back to its original size and orientation as shown in FIG. 4. Also, the upper and lower wall portions 42, 44 of the back wall 32 position themselves such that they form about a ninety degree angle with the deck 12. Eventually, the top folded rim 28 and the bottom folded rim 50 are able to capture the electronic price label 54 within the interior area 52 of the label holder 16.

Transitioning the label holder 16 between flexed and relaxed states 74, 80 as described above and shown in FIGS. 5 and 4, respectively, may be repeated as desired. As such, the electronic price label 54 is generally considered releasably secured within the label holder 16 of the channel 10 and may, at times, be removed, repositioned, repaired, and the like as needed. Additional electronic price labels 54 may also be added as needed.

Figure 6:
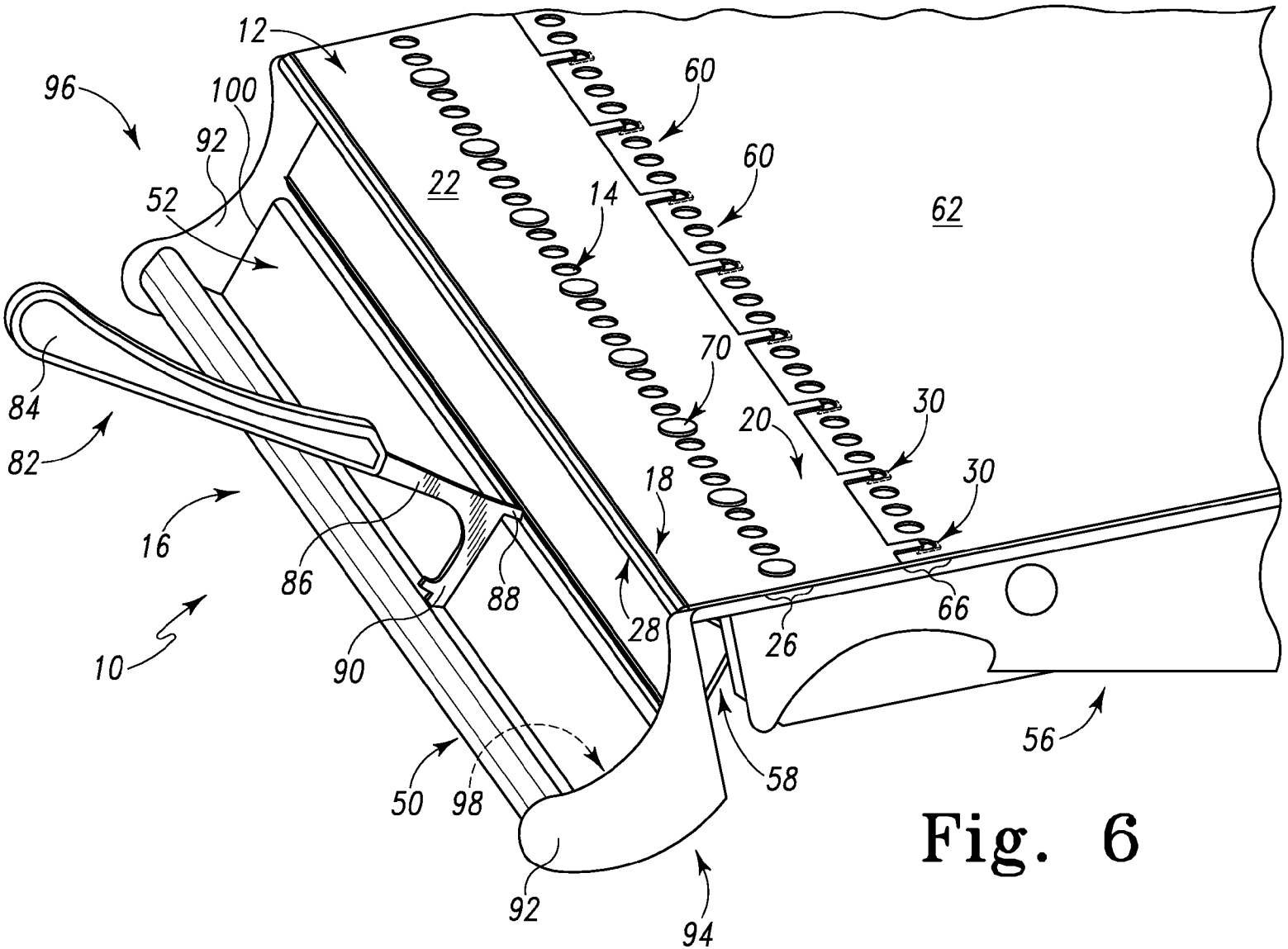
FIG. 6 is a top and front perspective view of a tool used to transition the roll formed channel of FIG. 1 from the relaxed state of FIG. 4 to the flexed state of FIG. 5.

In one embodiment as shown in FIG. 6, a tool 82 is employed to provide the requisite force 78 to move the label holder 16 into the flexed position of FIG. 5. The tool 82 includes a handle portion 84 and a working end 86. The working end 86 has a tip 88 sized and dimensioned to fit within the trough 48. The working end 86 further includes a downwardly depending leg 90 configured to engage the bottom wall 36, the back wall 32, or a combination thereof. When a downward force is applied to the handle portion 84 of the tool 82, the bottom portion 76 of the back wall 32 is pivoted backwardly about the pivoting structure 40 as noted above.

To secure the electronic price labels 54 within the price label holder 16, end caps 92 are used. The end caps 92 (a.k.a., end mounting brackets) are disposed on either side 94, 96 of the channel 10 as shown in FIG. 6. The end caps 92 may be supported by either the retail shelf 56 or the channel 10. When the end caps 92 are employed, the electronic price labels 54 cannot be slid out of the ends 98, 100 of the label holder 16. The end caps 92 also protect the otherwise exposed ends 98, 100 of the channel 10 from damage. Even so, the end caps 92 need not extend over or cover the exposed ends 98, 100 entirely. The end caps 92 are manufactured from a variety of suitable materials such as, for example, metal or plastic. If, however, the end caps 92 are omitted, the electronic price labels 54 may be slid into position within the label holder 16.

Figure 7:
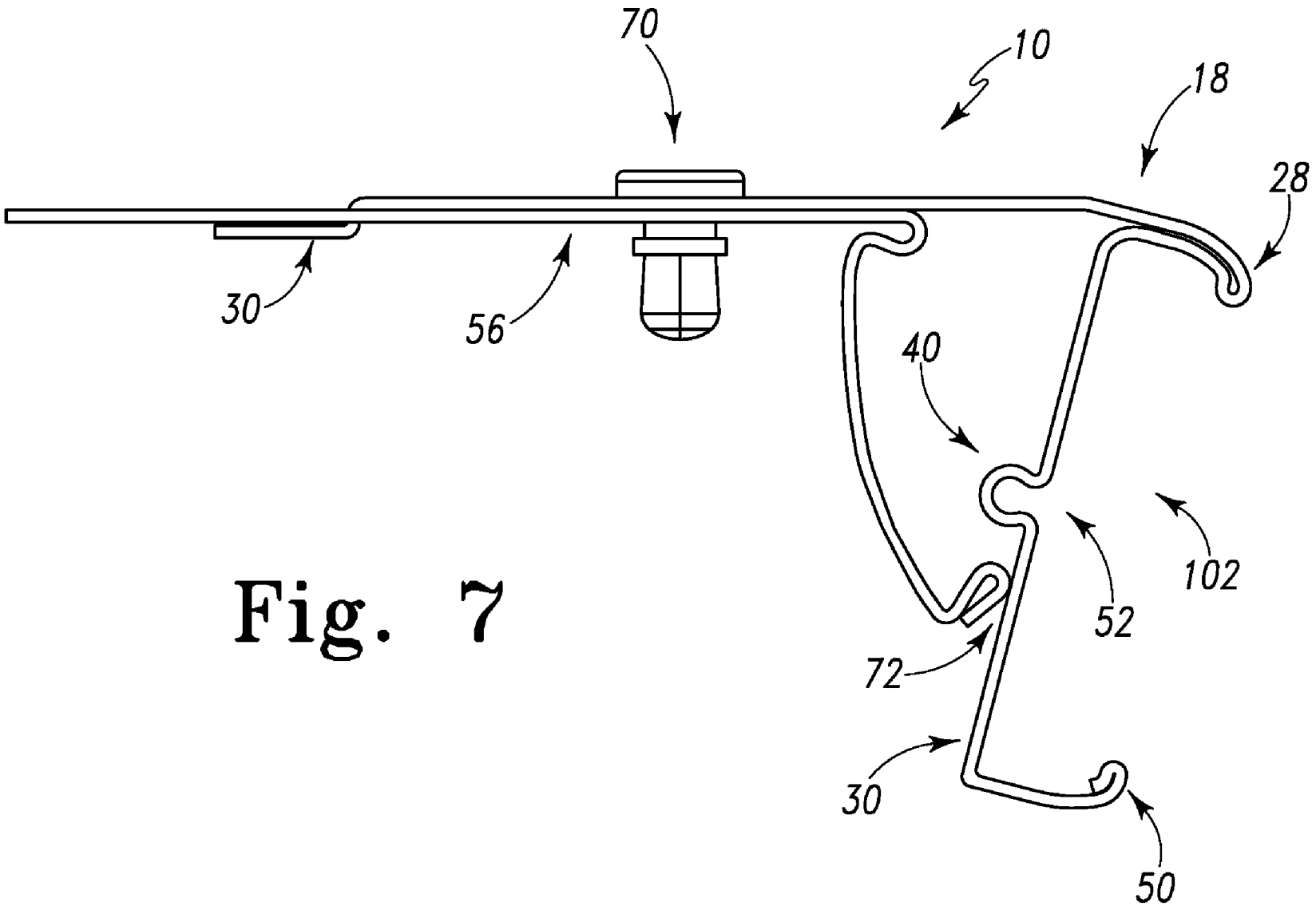
FIG. 7 is an embodiment of the roll formed channel of FIG. 1 with the label holder rotated rearwardly to direct the label holder downwardly toward a consumer.
Figure 8:
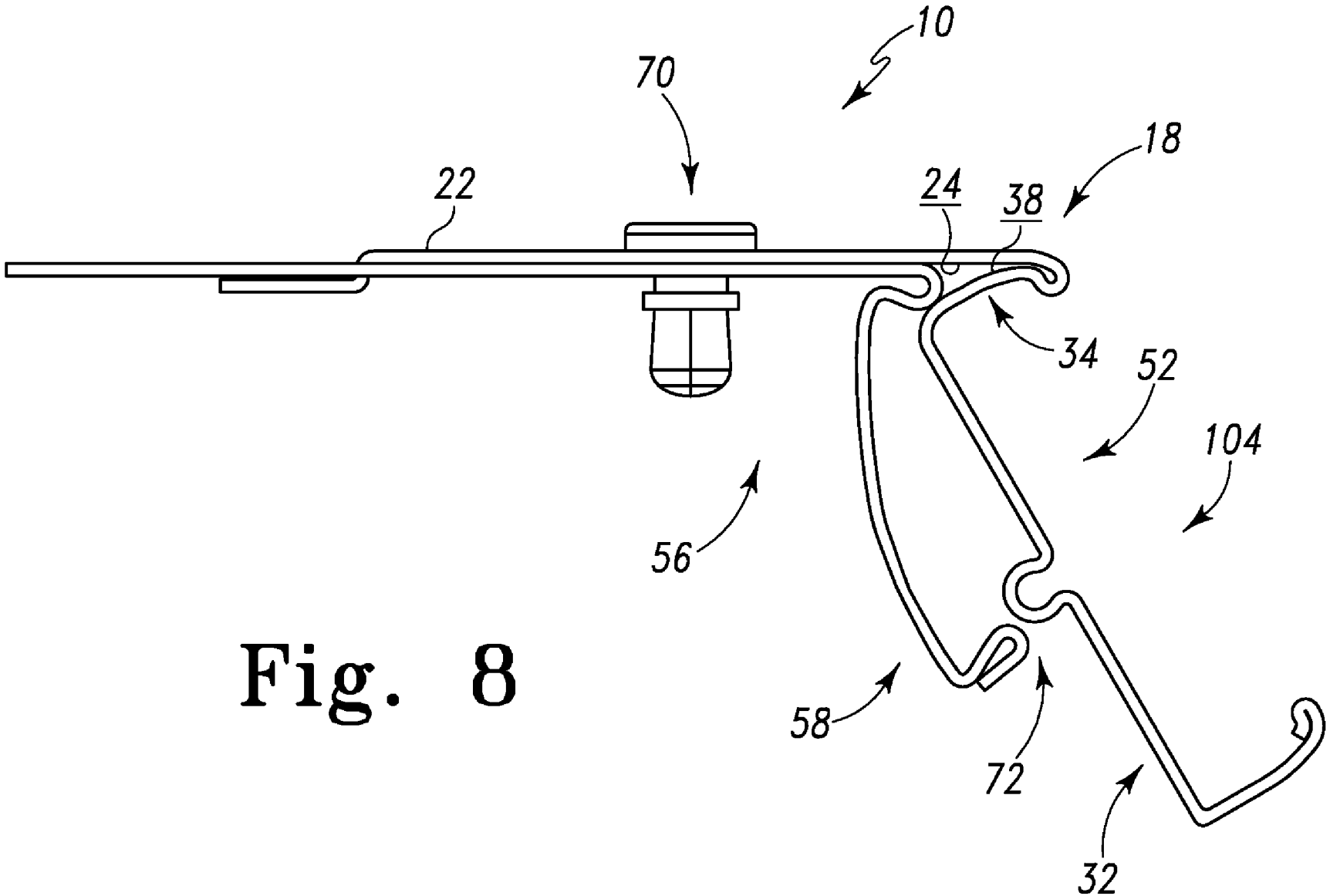
FIG. 8 is an embodiment of the roll formed channel of FIG. 1 with the label holder rotated forwardly to direct the label holder upwardly toward a consumer.
Figure 9:
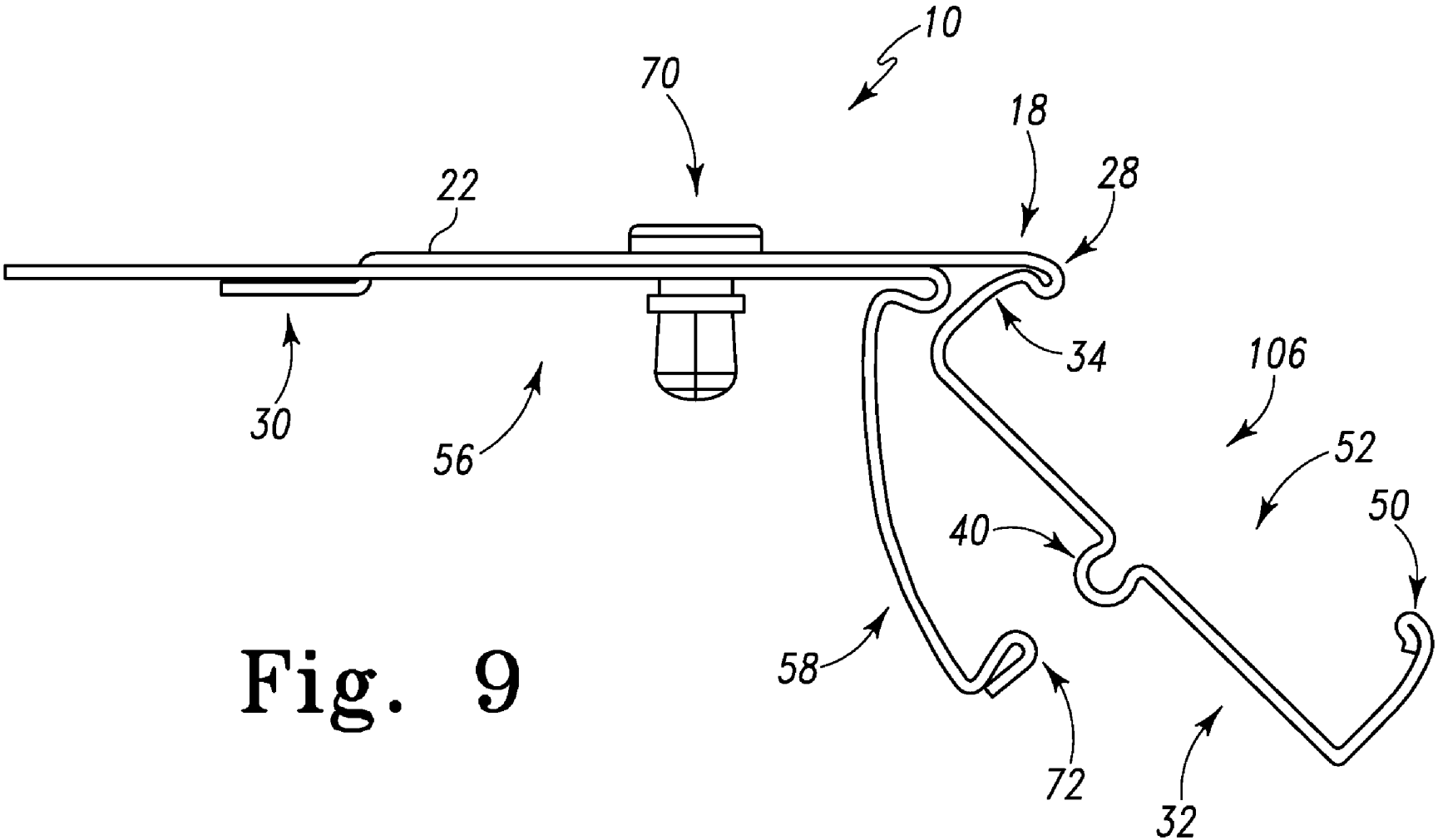
FIG. 9 is an embodiment of the roll formed channel of FIG. 1 with the label holder rotated further forwardly to direct the label holder further upwardly toward a consumer.

In the embodiment illustrated in FIG. 7-9, the label holders 102, 104, 106 are swung rearwardly or forwardly relative to the label holder 16 in FIG. 4. In FIG. 7, the label holder 16 is generally rotated clockwise about the front deck portion 18, which now slopes downwardly, such that the interior area 52 of the label holder 102 opens downwardly. As a result, the label holder 102 of FIG. 7 may be better suited for mounting on a retail shelf 56 generally above the eye level of a consumer. In other words, the label holder of FIG. 7 would normally be secured to a retail shelf far above the floor in a retail establishment.

In contrast to the label holder of FIG. 7, the label holder 104 of FIG. 8 is generally rotated counterclockwise about the front deck portion 18. Therefore, some of the top surface 38 of the top wall 34 is spaced apart from the bottom surface 24 of the deck 12. Also, the back wall 32 is disengaged from the bottom lip 72 of the C-channel 58 on the retail shelf 56 and the interior area 52 of the label holder 104 opens upwardly. As a result, the label holder 104 of FIG. 8 may be better suited for mounting on a retail shelf 56 generally below the eye level of a consumer. In other words, the label holder of FIG. 8 would normally be secured to a retail shelf somewhat close to the floor in a retail establishment.

Like the label holder of FIG. 8, the label holder 106 of FIG. 9 is rotated further counterclockwise about the front deck portion 18. Therefore, the back wall 32 is even further spaced apart from the front rim 68 of the C-channel 58 on the retail shelf and the interior area 52 of the label holder 106 is even further upwardly directed. As a result, the label holder 106 of FIG. 9 may be better suited for mounting on a retail shelf 56 far below the eye level of a consumer. In other words, the label holder of FIG. 8 would normally be secured to a retail shelf 56 very close to, or just off, the floor in a retail establishment. In FIGS. 7-9, the back wall 32 of the label holder 102, 104, 106 generally forms an angle with the deck 12 that is less than eighty degrees or more than one hundred degrees in an effort to direct the label holder toward the direct line of sight for a consumer.

Figure 10:
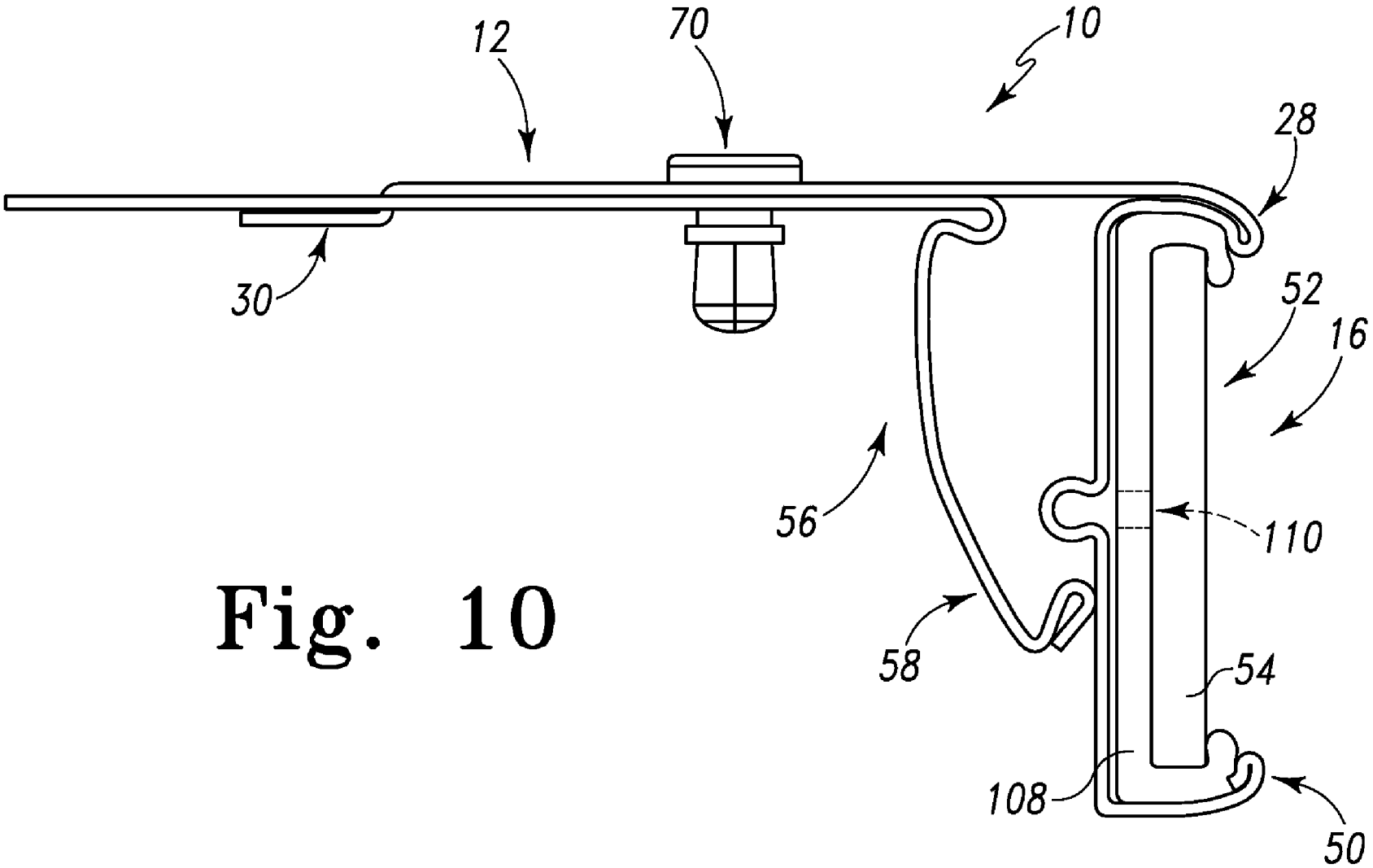
FIG. 10 is an embodiment of the roll formed channel of FIG. 1 including an insert permitting the label holder to accommodate electronic price labels of varying dimensions.

In one embodiment as shown in FIG. 10, an insert 108 (a.k.a., a liner) is used with the label holder 16 (or the label holders 102-106 of FIGS. 7-9, which will be collectively referred to as label holder 16). When placed within the label holder 16, the insert 108 effectively reduces or alters the size of the interior area 52. Therefore, the label holder 16 is able to accommodate electronic price labels 54 having a variety of different sizes and dimensions. In addition, the insert 108 may be configured to support components other than the electronic price label 54 such as, for example, shelf talkers and coupon displays.

The insert 108 is formed from a variety of suitable materials such as, for example, rubber, plastic, and metal. In the embodiment of FIG. 10, the insert 108 includes an aperture or slot 110 generally aligned with the trough 48. Therefore, the tip 88 of the tool 82 depicted in FIG. 6 may be inserted into, and received by, the trough 48.

Figure 11:
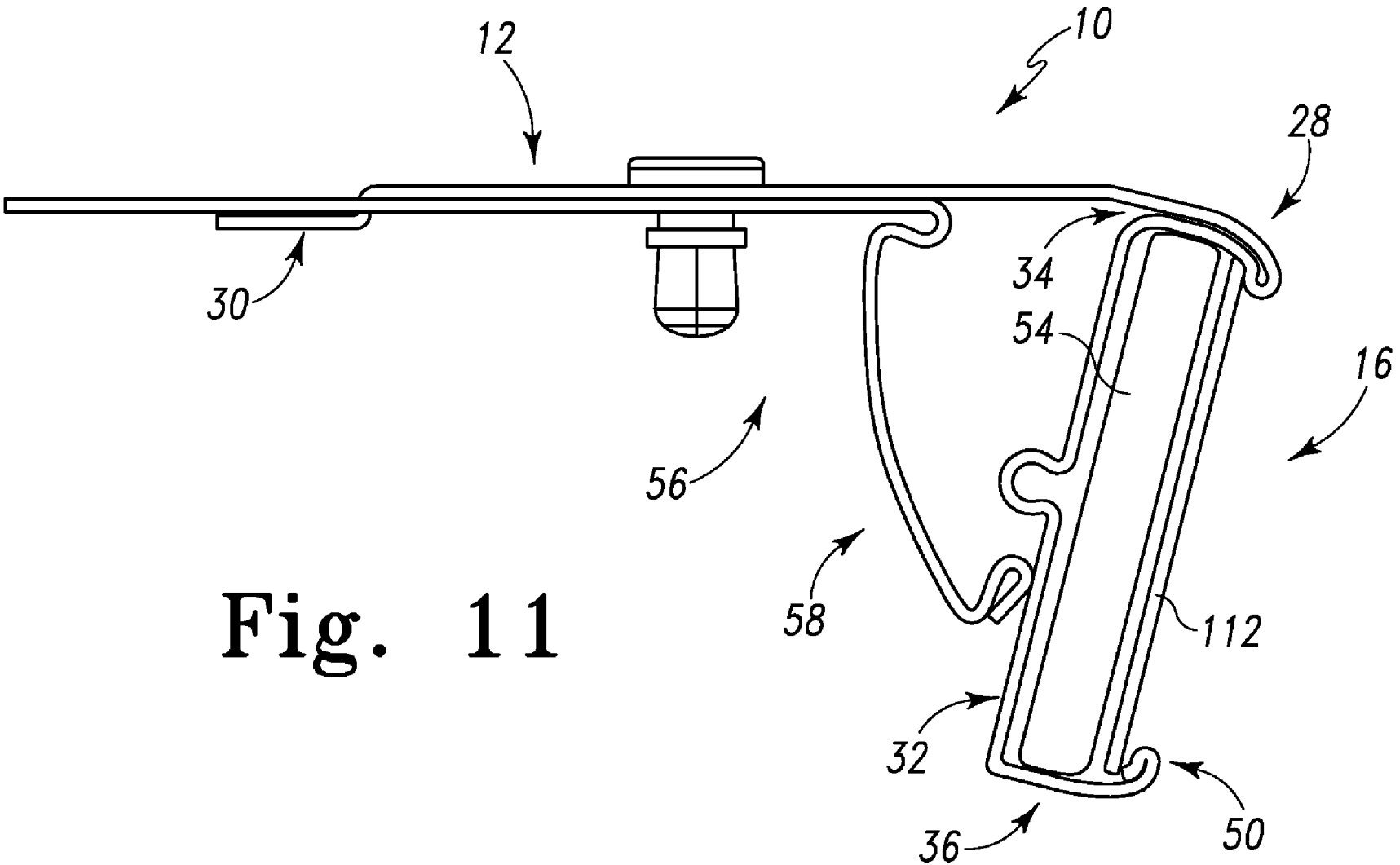
FIG. 11 is an embodiment of the roll formed channel of FIG. 1 having a protective cover or lens disposed in front of the electronic price label.

In one embodiment as shown in FIG. 11, a cover 112 is disposed in front of the electronic price label 54 in the interior area 52. As shown, the cover 112 is generally held in place by the top and bottom folded rims 28, 50, the top and bottom walls 34, 36, or some combination thereof. The cover 112 is generally transparent or translucent and formed from plastic. The cover 112 may also be a lens, which magnifies the information displayed by the electronic price label 54. Despite the illustrated embodiment having the cover 112 disposed within the interior area 52, the cover may also be mounted over the label holder 16 in other embodiments. The cover 112 may include an integral slot or channel for the purpose of holding a temporary sign.

Figure 12:
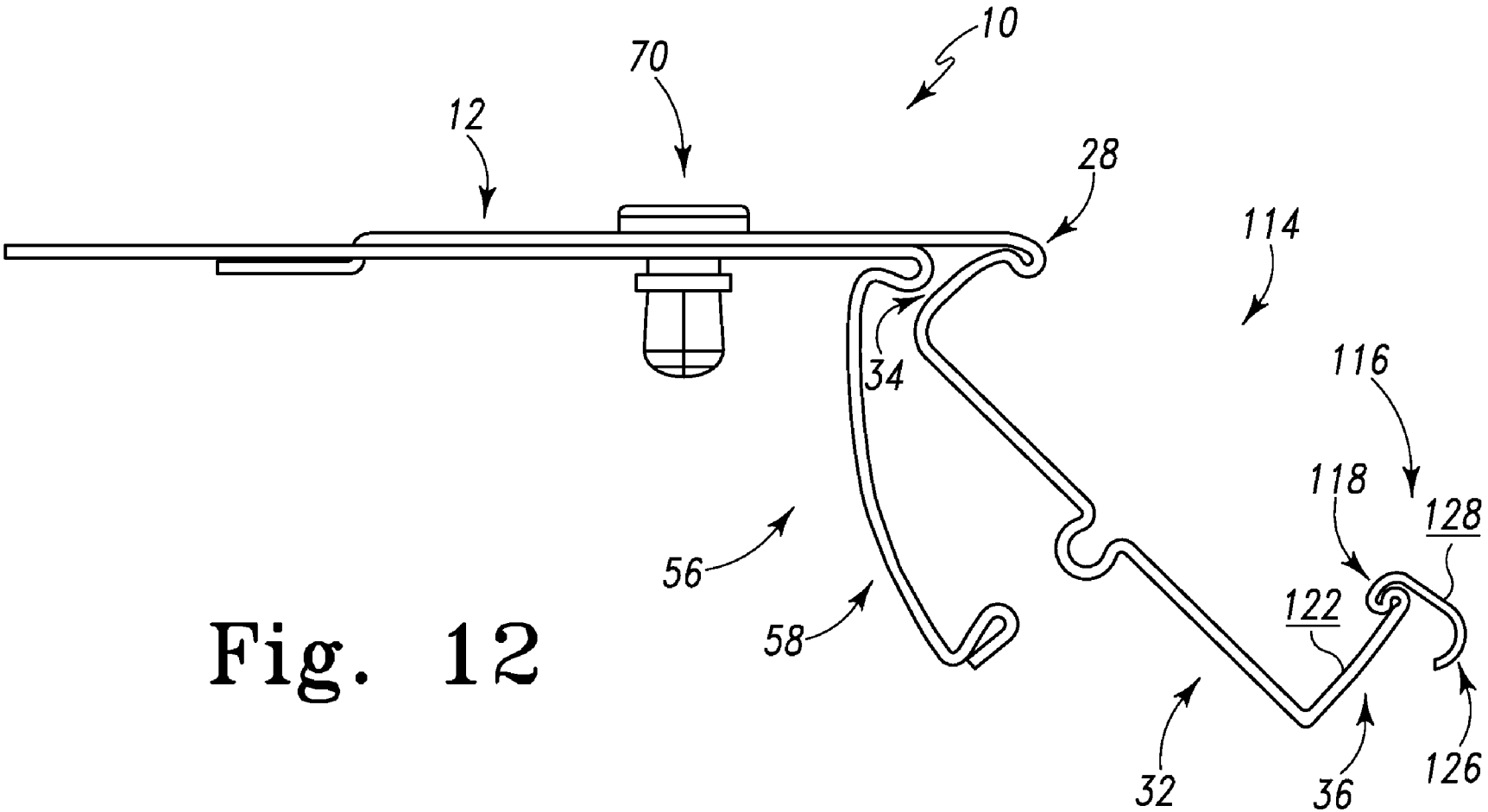
FIG. 12 is an embodiment of the roll formed channel of FIG. 1 having a bumper.

To further protect the electronic price label 54, the label holder 114 of FIG. 12 includes a bumper 116. Other label holders 16, 102-106 may also include and incorporate the bumper 116. The bumper 116 is generally supported by a forward portion 118 of the bottom wall 36 of the label holder 114. In the illustrated embodiment, the bumper 116 is unitarily formed with the bottom wall 36. However, the bumper 116 may also be a separate piece that is attachable to, for example, the bottom wall 36. A top portion 120 of the bumper 116 is disposed above and folded rearwardly onto a top surface 122 of the bottom wall 36. A bottom portion 124 of the bumper 116 is disposed below the bottom wall 36. As shown, a distal end 126 of the bottom portion 124 is curled rearwardly toward the deck 12.

Like the cover 112 of FIG. 11, the bumper 116 of FIG. 12 is employed to protect the electronic price label 54. In that regard, an outside surface 128 of the bumper 116 is expected to engage objects such as, for example, a shopping cart prior to those objects impacting the electronic price label 54. The bumper 116 and cover 112, which may be used in combination, provide an extra measure of security to ensure that the electronic label 54 is not damaged.

Figure 13:
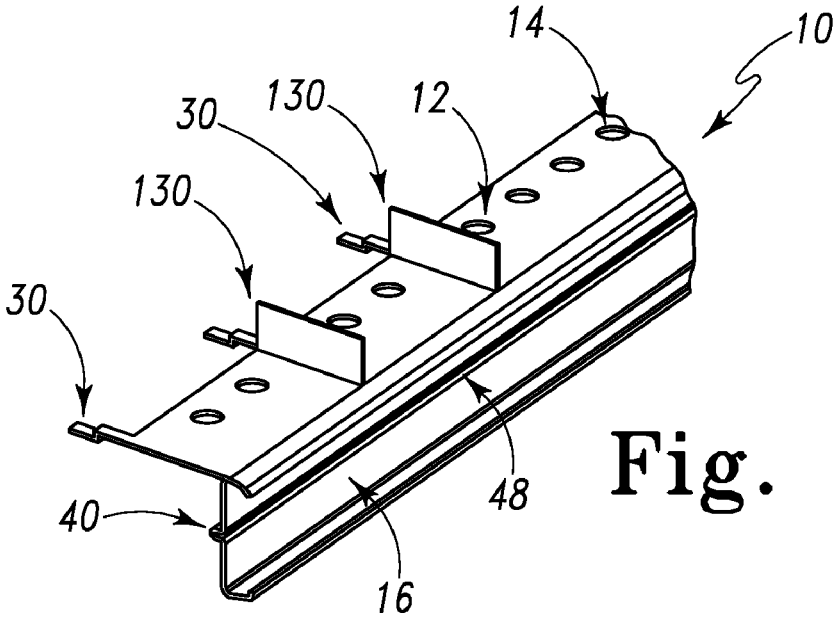
FIG. 13 is an embodiment of the roll formed channel of FIG. 1 including dividers.

In one embodiment as illustrated in FIG. 13, the channel 10 includes a plurality of dividers 130. The dividers 130 are supported by, and generally transverse to, the deck 12. The dividers 130 are oriented to extend from proximate the front deck portion 18 to the rear deck portion 20. In other words, the dividers 130 are generally transverse to the top folded rim 28 of the channel 10. The dividers 130 are used to separate one row of products from adjacent rows of products. The dividers 130 may extend vertically above the top surface 22 of the deck 12 to a variety of heights depending on numerous factors such as, for example, the height of the product and the space between stacked shelves.

Figure 14:
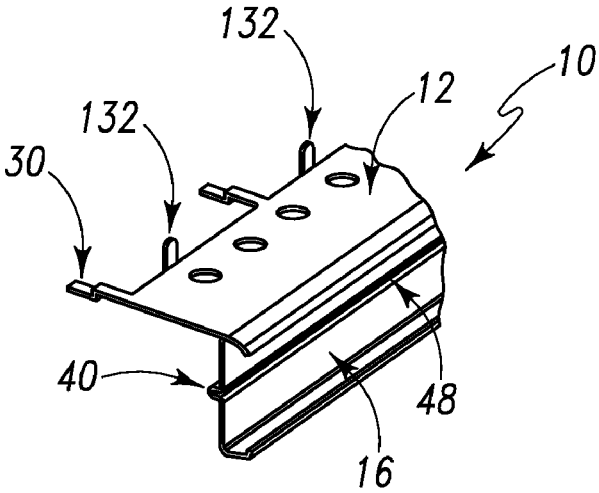
FIG. 14 is an embodiment of the roll formed channel of FIG. 1 including anchoring structures.

As shown in FIG. 14, the channel 10 also includes a plurality of anchoring structures 132 proximate the rear deck portion 20. The anchoring structures 132 are used to anchor other well known and typical retail product features to the channel 10. For example, the anchoring structures 132 are suitably employed to secure, for example, product pusher systems or the dividers 130 of FIG. 13. In the illustrated embodiment, the anchoring structures 132 are depicted as vertically-extending flanges. However, in other embodiments the anchoring structures 132 are grooves, slots, apertures, and the like.

Figure 15:
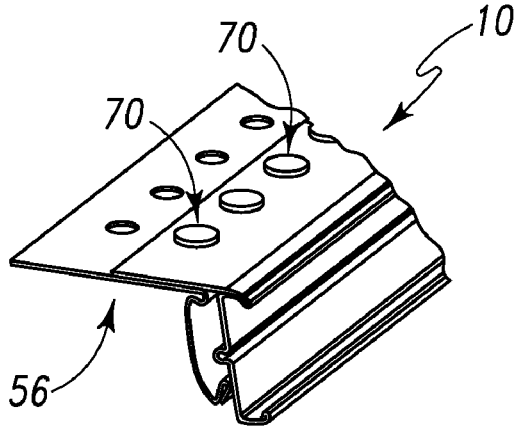
FIG. 15 is an embodiment of the roll formed channel of FIG. 1 with the tabs removed.
Figure 16:
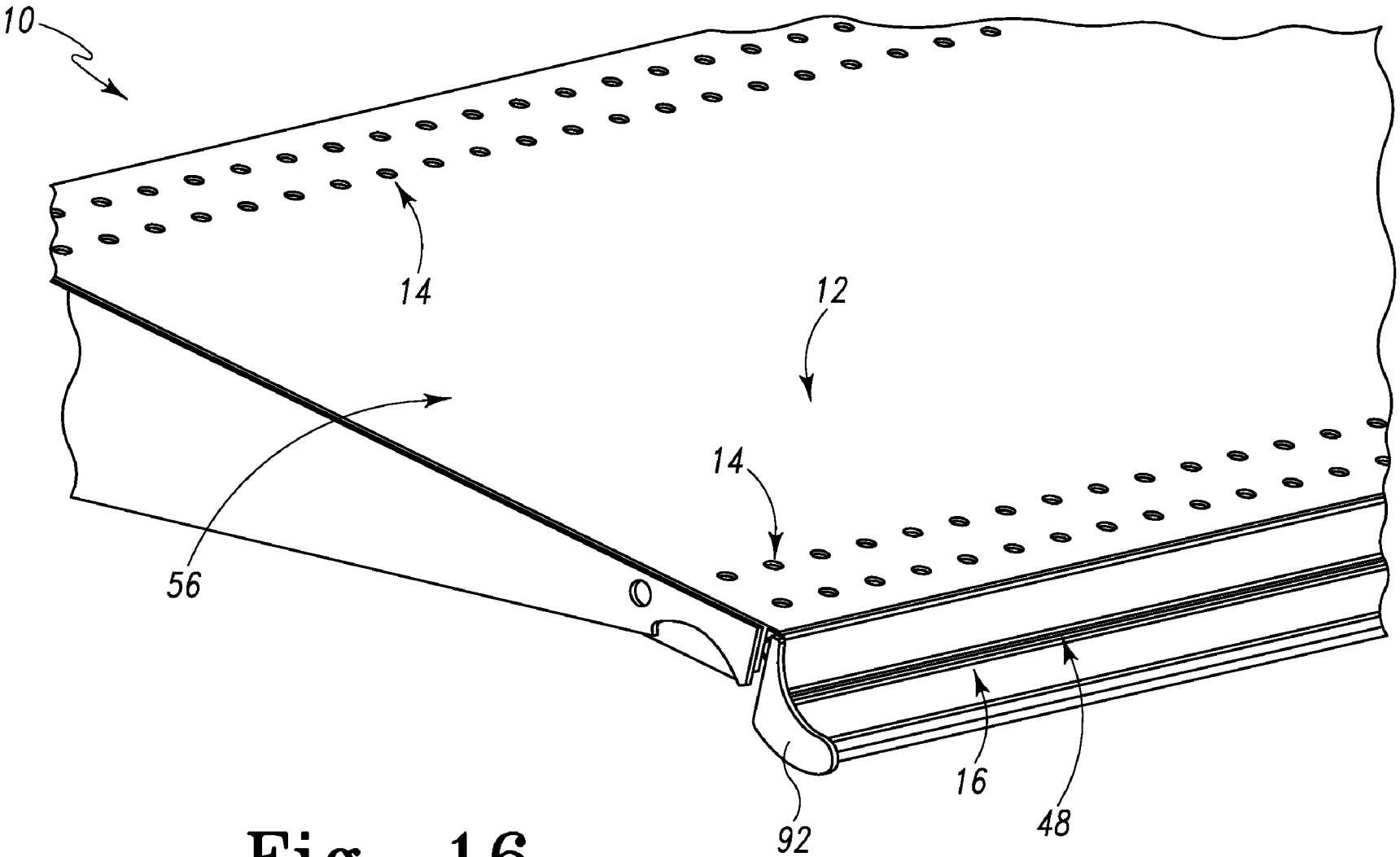
FIG. 16 is an embodiment of a roll formed channel having an expanded deck to form and function as a retail shelf.

Moving to FIG. 15, the channel 10 may be formed without the tabs 30 shown in several of the figures including FIG. 1. In such cases, the channel 10 is secured to the retail shelf 56 via the securement device 70 (e.g., rivet) alone. If need be, additional securement devices 70 may be employed to replace the support provided by the tabs 30 in other embodiments. Also, if the deck 12 is expanded to a sufficient width as shown in FIG. 16, the channel 10 may form and function as a retail shelf configured to accommodate electronic price labels 54.

The roll formed channel 10 may include a coating such as, for example, paint in one of a variety of different colors, to match the color of the retail shelf 56 and to enhance the aesthetic quality of the channel 10. The coating may also be TEFLON® or other friction-reducing substance to permit consumer products (not shown) to more easily slide over or upon the channel 10.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A label holder for attachment to or integrated into a retail shelf, comprising:

a deck including a front deck portion and a back deck portion; and an electronic price label holder supported by the front deck portion, the electronic price label holder having a back wall extending between a top wall and a bottom wall to form a retention channel, the back wall including a hinge structure such that an entrance opening in the retention channel is expandable and retractable for receipt of electronic price labels.

2. The label holder of claim 1, wherein the electronic price label holder further comprises means for securing the deck to the retail shelf.

3. The label holder of claim 2, wherein the means for securing is at least one of a plurality of tabs extending away from the back deck portion and a plurality of deck apertures for receiving a push pin.

4. The label holder of claim 1, wherein the hinge structure is a rearwardly-extending. rounded projection forming an elongated forwardly-facing trough in the back wall.

5. The label holder of claim 1, wherein the back wall is divided into an upper wall portion and a lower wall portion by the hinge structure, the upper and lower wall portion defining upper and lower rims, respectively, projecting at least partially toward each other, the lower wall portion being pivoted relative to the upper wall portion about the hinge structure to widen or narrow the entrance opening formed between the upper and lower rims, wherein the rims retain an electronic price label either fully or partially in the retention channel.

6. The label holder of claim 5, wherein the electronic price label holder is formed of sheet metal, wherein a forward portion of the bottom wall is folded over to form the lower rim.

7. The label holder of claim 6, wherein the retention channel has a depth that fully receives the electronic price label therein such that the electronic price label does not project forwardly of the opening when trapped between and behind the upper and lower rims.

8. The label holder of claim 1, wherein the electronic price label holder supports a transparent cover or lens, and wherein the electronic price label holder further includes an electronic price label covered by the cover or lens; the transparent cover or lens is independent and separate of and forms no part of the electronic price label.

9. The label holder of claim 1, wherein the electronic price label holder supports an insert or liner, further comprising an electronic price label engaging at least in part the insert or liner, the insert or liner being entirely housed within the retention channel of the electronic price label holder.

10. The label holder of claim 1, wherein the electronic price label holder is permanently integrated into a shelf structure, and wherein the deck forms a top surface of the shelf for supporting retail products.

11. The label holder of claim 1, wherein the electronic price label holder is a roll formed structure formed from sheet metal such that a sheet metal body of the electronic price label holder has a generally constant cross sectional thickness normal to a sheet metal exterior surface.

12. The label holder of claim 11, wherein the deck and electronic price label holder are unitarily formed with each other, and wherein the top wall and the deck are joined by a top rim folded into the metal body and the bottom wall is folded over upon itself to form a bottom folded rim.

13. The label holder of claim 1, further comprising an electronic price label mounted into the retention channel.

14. The label holder of claim 1, wherein the electronic price label holder includes an anchoring structure proximate the rear portion of the deck, the anchoring structure selected from a group consisting of a vertically-extending lip, a groove, a slot, and an anchoring aperture.

15. The label holder of claim 1, wherein the channel further comprises a plurality of dividers, the dividers supported by and generally transverse to the deck, the dividers oriented to extend from proximate the front deck portion to the rear deck portion.

16. The label holder of claim 1, wherein the channel includes ends at either side of the channel, and wherein the ends are protected by end caps.

17. The label holder of claim 1, wherein the deck includes a plurality of apertures arranged in at least one row, further comprising a plurality of tabs unitarily formed with the deck and extending away from a back deck portion, each of the tabs including a rear tab portion generally parallel to and offset below the deck; and wherein the electronic price label holder is unitarily formed with the deck in the form of a roll formed sheet metal attachment for selectively mounting to a top surface of a shelf where product is stored with the top wall of the electronic price label holder being folded over a bottom surface of the front deck portion to form an upper folded rim, and the lower wall of the holder folded over upon itself to form a lower folded rim, and wherein the hinge structure includes a trough having an opening facing away from the tabs, the opening having a first size when the electronic price label holder is in a flexed state and a second size when the electronic price label holder is in a relaxed state, the first size larger than the second size.

18. The label holder of claim 1, wherein the channel is operably transitionable by a tool engaging only the electronic price label holder during operation between a relaxed state and a flexed state about the hinge so that the entrance opening in the retention channel can be expanded or retracted to selectively receive, remove or retain a electronic price label.

19. A combination comprising:

an electronic price label holder for attachment to or integrated into a retail shelf, the label holder including a channel integrally roll formed into a metal body; and an electronic price label mounted at least partially into the roll formed channel; and further comprising a deck, and wherein the electronic price label holder is unitarily formed with the deck, the roll formed channel having a back wall extending between a top wall and a bottom wall with the top wall of the holder being folded over a bottom surface of the front deck portion to form an upper folded rim, and a lower wall of the holder folded over upon itself to form a lower folded rim, the upper and lower folded rim engaging the electronic price label to secure the electronic price label to the electronic price label holder.

20. The combination of claim 19, wherein the electronic price label holder is in the form of an attachment for a shelf, the attachment including a plurality of apertures formed into the deck arranged in at least one row, further comprising plurality of tabs unitarily formed with the deck and extending away from a back deck portion, each of the tabs including a rear tab portion generally parallel to and offset below the deck.

21. The combination of claim 19, wherein the electronic price label holder is integrally formed into a shelf.

22. The combination of claim 19, further comprising a hinge structure integrally rolled formed hinge structure, the upper rim and the lower rim being movable away from each other via pivoting movement about the hinge structure.

23. A label holder system, comprising:

a retail shelf for supporting retail merchandise including a plurality of apertures formed through a top surface of the shelf;

a label holder formed of metal material integrated into the retail shelf as a front edge of the retail shelf, an electronic price label holder supported by retail shelf;

an electronic price label mounted in the electronic price label holder; and the electronic price label holder includes a plurality of tabs extending away from a back deck portion of the electronic price label holder, the plurality of tabs engaged within a second row of the apertures in the retail shelf the second row of apertures formed through a top surface of the shelf where merchandise is supported such that the back deck portion of the electronic price label holder overlaps the top surface of the shelf where merchandise is supported, the second row parallel to a first row of apertures; and wherein the retail shelf includes a c-channel forming the label holder and a front face of the shelf, the back wall of the electronic price label holder pressed against a bottom lip of the c-channel such that the bottom lip provides lateral support for the electronic price label holder, the electronic price label holder being only secured to the retail shelf by engagement with the top surface and being free of engagement with undercuts defined by the c-channel.

24. The label holder system of claim 23, wherein the electronic price label holder is formed from metal.

25. The label holder system of claim 23, wherein the electronic price label holder supports a protective feature selected from the group consisting of a lens, a cover, and a bumper, the electronic price label holder is independent and separate of and therefore forms no part of the protective feature.

26. A combination, comprising:

a retail shelf in combination with an electronic price label, the retail shelf including:

a deck for supporting retail merchandise, the deck including a front deck portion; and an electronic price label holder integrated into the shelf and depending downwardly from the front deck portion, the electronic price label being retained by the electronic price label holder; and wherein the electronic price label holder has a back wall extending between a top wall and a bottom wall, the back wall including a hinge structure dividing the back wall into upper and lower sections, the upper and lower section pivotable about the hinge such that an electronic price label may be inserted therein.

* * * * *